US005178945A

United States Patent [19]

Kawamoto et al.

[11] Patent Number: 5,178,945

[45] Date of Patent: Jan. 12, 1993

[54] POLYESTER FIBER HAVING DURABLE WATER ABSORBENT PROPERTY

[75] Inventors: Masao Kawamoto; Kazuhiko Tanaka, both of Kurashiki, Japan

[73] Assignee: Kuraray Co., Ltd., Kurashiki, Japan

[21] Appl. No.: 661,255

[22] Filed: Feb. 27, 1991

[51] Int. Cl.[5] ..... D02G 3/00

[52] U.S. Cl. ..... 428/364; 428/359; 428/373; 428/374

[58] Field of Search ..... 428/359, 364, 373, 374; 425/408

[56] References Cited

U.S. PATENT DOCUMENTS 3,544,658 12/1970 East et al. ..... 525/408
4,585,835 4/1986 Saegusa et al. ..... 525/408

FOREIGN PATENT DOCUMENTS 58-080391 5/1983 Japan .
1172085 11/1969 United Kingdom ..... 525/408

*Primary Examiner*—Patrick J. Ryan
*Assistant Examiner*—J. M. Gray
*Attorney, Agent, or Firm*—Oblon, Spivak, McClelland, Maier & Neustadt

[57] ABSTRACT

Provided are polyester fibers containing 0.2 to 20% by weight of a compound having a polyalkylenepolyamine skeleton to which groups having a polyalkylene oxide chain are bonded and having an HLB of 6.0 to 16.0, an average molecular weight of at least 10,000 and an amine value of not more than 500. These fibers have excellent water absorbency with durability like that of natural fibers.

11 Claims, No Drawings

POLYESTER FIBER HAVING DURABLE WATER ABSORBENT PROPERTY

BACKGROUND OF THE INVENTION

1. Field of the Invention

The present invention relates to polyester fibers having excellent water absorbency, and more specifically, to polyester fibers having high water absorbency with high durability.

2. Description of the Prior Art

The term "water absorbency" of a fiber herein means the property to absorb water when the fiber takes the form of a fiber mass, yarn, strand, woven, knit or nonwoven fabrics or like fiber aggregate. To achieve this property, fibers should have a surface that is highly hydrophilic or wettable, but their individual filaments need not necessarily absorb or swell with water or moisture by themselves. Hydrophobic synthetic fibers, such as polyester fiber and polypropylene fiber, are literally hydrophobic and markedly inferior in water absorbency to cotton, regenerated cellulose fiber and the like, and have thus encountered problems when applied to uses requiring water absorbency. Attempts have therefore been made to increase the water absorbency of synthetic fibers while maintaining their excellent features such as good permanent setting property. So far, regretfully, water absorbency comparable to that of natural fibers has either not been obtained or, if obtained, was obtained only with such a sophisticated modifying process as to make the product too expensive to be widely used.

In recent years, fibers of polyesters, as represented by polyethylene terephthalate, have been playing increasingly important roles in textile uses, particularly as raw materials for nonwoven fabrics. Nonwoven fabrics have become widely used in the fields of sanitary applications, (e.g. disposable diapers, diaper liners and sanitary napkins, wipes for fast-food restaurants, household uses, (e.g. wipes and water-separating bags for the kitchen sink), medical uses, (e.g. base fabrics and fixing sheets for medical plasters, surgical gowns and masks, and the like). Durable water absorbency is desired, among the above uses for wipes and some sanitary applications.

Conventional hydrophilic polyester fibers are mostly provided with hydrophilicity by application of a finish onto their surface. Although these fibers exhibit hydrophilicity at the initial stage of their use, most of them rapidly lose the property during use due to removal of the finish from the surface.

When used for those nonwoven fabrics that are wet treated during their manufacturing process, the polyester fibers with initial hydrophilicity provided by application of a finish can, not provide the obtained fabrics with sufficient hydrophilicity because of loss of the finish during the wet treatment process.

Known are processes for providing polyester fiber with absorbency of water or moisture. Examples of these include incorporation of, polyethylene glycol or sodium dodecylbenzenesulfonate into the polyester constituting the fiber before spinning copolymerizing polyethylene glycol with polyester (see, Japanese Patent Application Laid-open No. 138617/1979). Fibers obtained by the above process of incorporation, however, display only initial water absorbency, with the level of hydrophilicity markedly decreasing with repeated washing. Furthermore, surface active agents such as sodium dodecylbenzenesulfonate are known to be toxic to humans and hence cannot be said to be suited for uses where the textiles containing them come into direct dermal contact with humans. Fibers obtained by the above process of copolymerization cannot exhibt water absorbency when the copolymerization ratio is small and, on the other hand, an increased ratio of the copolymerization component to give a satisfactory absorbency significantly adversely affects the other excellent properties inherent to polyester fiber. Accordingly, the above processes have failed in providng a polyester fiber having satisfactory water absorbent property.

SUMMARY OF THE INVENTION

An object of the present invention is to provide a polyester fiber having excellent water absorbency resembling that of natural fibers, said water absorbency being durable with little decrease by repeated washing and non-hazardous to humans.

The present invention provides a polyester fiber having durable water absorbency, said polyester fiber containing a specified amount of a compound dispersed therein, said compound satisfying specific conditions and comprising a polyalkylenepolyamine skeleton to which groups having a polyalkylene oxide chain are bonded. More specifically, the present invention provides a polyester fiber containing 0.2 to 20% by weight of a compound having a polyalkylenepolyamine skeleton to which a groups having polyalkylene oxide chain are bonded and having an HLB of 6.0 to 16.0, an average molecular weight of at least 10,000 and an amine value of not more than 500.

DETAILED DESCRIPTION OF THE PREFERRED EMBODIMENTS

The compounds (hereinafter referred to as "N-POA compounds") used in the present invention comprising a polyalkylenepolyamine skeleton to which, groups having a polyalkylene oxide chain are bonded, are generally produced by adding lower alkylene oxide gases to a polyalkylenepolyamine skeleton in the presence of alkali catalyst. (See Japanese Patent Application Laid-open No. 80391/1983.) The polyalkylenepolyamine skeleton itself is generally produced by polymerization of the appropriate alkylenediamine or its derivatives. Thus, the polyalkylenepolyamine skeleton may contain other groups, such as a carbonyl group. The N-POA compounds preferably have no substantial reactivity with the polyester used which is later described herein. The phrase "have no substantial reactivity" herein means that they do not copolymerize with the polyester. Reaction of N-POA compounds with polyester is not preferred since it impairs spinnability, i.e. decreases the degree of polymerization of the polyester, whereby the melt viscosity extremely decreases to render spinnability unstable forming fibers having abnormal cross sections and continuous spinning operation will become difficult due to the occurrence of many fluffs and frequent filament breakages.

It is preferred that the groups having a polyalkylene oxide chain be bonded to the nitrogen atoms of the polyalkylenepolyamine skeleton. The N-POA compounds used in the present invention therefore include those having amino groups and imino groups in which substantially all of the n bonded hydrogen atoms are replaced with groups having a polyalkylene oxide chain.

It is necessary that the N-POA compounds have a molecular weight of at least 10,000, preferably 10,000 to 100,000. With too low a molecular weight, they react actively with polyester to generate the aforementioned problems, or if do not react therewith, their compatibility with polyester becomes worse to impairing threadability at spinning, thereby generating many fluffs and frequent filament breakages during spinning.

The N-POA compounds preferably have a structure comprising amine portions, i.e. amino groups and imino groups with which oxyethylene units and oxypropylene units are randomly or blockwise copolymerized. An example of this structure is shown below,

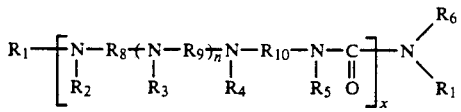

(1)

wherein $R_1$ through $R_7$ are each a group composed of a polyalkylene oxide chain or a hydrogen atom, and $R_8$ through $R_{10}$, which may be the same or different, are each a lower alkylene group such as ethylene, propylene or butylene group. Here it is not necessary that $R_3$'s, which are present in the molecule of FIG. 1 in a number of $n \times x$, be the same. Further, it is not necessary that $R_2$, $R_4$ and $R_5$, which are all present in a number of x, each be the same. The n of the polyalkylenepolyamine chain constituting the skeleton is preferably 0 to 10, and more preferably 0 to 5. If n is too large, the compound will lose its property of providing polyester, when kneaded thereinto, with sufficient water absorbency. Preferably x is 1 to 20 and more preferably 1 to 5. If x is too large, the obtained fiber will tend to color during spinning.

It is necessary that the groups, $R_1$ through $R_7$, containing a polyalkylene oxide chain contain oxyethylene units and oxypropylene units. The oxyethylene units and the oxypropylene units are not necessarily present in combination in one and the same group. In other words, there may be present groups having a polyalkylene oxide chain containing only oxyethylene units and also groups having a polyalkylene oxide chain containing only oxypropylene units. There are often cases where hydrophilicity decreases, depending on the composition ratio between oxyethylene units and oxypropylene units, and it is preferred that oxyethylene units be principally contained within a limit not to impair the purpose of the present invention. It is recommendable to judge the preferred range of the content of oxyethylene units in terms of HLB value which is defined below. Preferred groups having a polyalkylene oxide chain are those comprising a block of oxypropylene units (PO) bonded to the N atom and a block of oxyethylene units bonded to the end of the oxypropylene groups as:

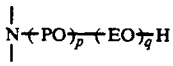

wherein p and q are each an integer of 1 or more.

HLB value is the Hydrophile-Lipophile Balance value proposed by Griffin in 1940 as a means to indicate the balance between the hydrophilic groups and lipophilic groups of a surface active agent, and is obtained from:

$$HLB \text{ value} = 20 \times M_H / M$$

where M is the molecular weight of the surface active agent and $M_H$ is that of the hydrophilic group part.

The HLB value equals=0 and for molecules having no hydrophilic groups and HLB=20 for those with 100% hydrophilic groups, respectively. The HLB of a compound having the same amount of hydrophilic and lipophilic groups is 10. For the N-POA compounds of the present invention, the HLB is calculated from the moles of oxyethylene units as hydrophilic groups and those of oxypropylene units as lipophilic groups, with the skeleton polyamine part being excluded.

The N-POA compounds used in the present invention have an HLB value ranging from 6.0 to 16.0. If the HLB value exceeds 16.0, fibers obtained from a polyester containing the N-POA compound will have a less durable water absorbency even though, they exhibit sufficient initial water absorbency. In particular, the durability upon washing will be insufficient, i.e., the water absorbency decreases after washing. This is thought to occur during washing by elution of the N-POA compound out of the polyester in which it was initially dispersed, due to the high hydrophilicity of the N-POA compound, thus making the fiber of the polyester poorer in water absorbency. On the other hand, if the HLB value is less than 6.0, the N-POA compound will exhibit hydrophobicity too intense to provide the fiber of the polyester with sufficient water absorbency.

The ends of the groups having a polyalkylene oxide chain may comprise hydroxyl groups, be blocked by organic groups that do not form esters or be bonded to other ester-forming organic groups by ether, ester, carbonate or like bonds. The groups may contain therein or in the root part thereof atoms other than ethylene oxide units and propylene oxide units.

It is not necessary that each of the amino and imide groups of the polyamine skeleton be bonded to a group having a polyalkylene oxide chain, and the skeleton may contain unreacted free amino or imino groups. Presence of too many free amino and imino groups however produces toxicity to humans and is not preferred. In particular, where a fiber comprising such a N-POA compound is used for articles directly touching human skin, they cause the problem of skin irritation. In view of the above, the N-POA compounds used in the present invention must have an amine value of not more than 500, preferably not more than 100. The amine value herein is the amount of acid required for neutralizing 1 g of a specimen compound as converted into milligrams of KOH.

The N-POA compounds used in the present invention have a polyalkylenepolyamine skeleton which must contain a plurality of alkylene groups and a plurality of nitrogen atoms that are present in amino groups or imino groups. If the skeleton contains only one alkylene group or only one nitrogen atom present in an amino or imino group, the N-POA compound will be poor in its compatibility with polyester and the object of the present invention cannot be achieved.

Not quite clear is the mechanism by which the N-POA compound used in the present invention provides the polyester fiber with excellent durable hydrophilicity. It however is attributable to the facts that the polyalkylenepolyamine skeleton has high compatibility with polyester, that the side-chain ethylene oxide units are excellent in hydrophilicity (wettability) and that the side-chain propylene oxide units have the controlling function of balancing the resistance to elution and hydrophilicity of the N-POA. These facts assure high wettability having excellent durability. This is supported by the fact that among compounds represented by the aforementioned formula (1), most preferred are those N-POA compounds comprising a polyalkylene-polyamine skeleton to which propylene oxide units first add as side chains, to the on which ethylene oxide units then add.

The N-POA compound so far described is added to a polyester in an amount of 0.2 to 20% by weight. With an addition less than 0.2% by weight, the desired water absorbency is not achieved, while that exceeding 20% by weight impairs spinnability. A single N-POA compound can be used or 2 or more N-POA compounds, each having different molecular weights, amine values HLB's, or like properties. The N-POA compound may contain an antioxidant. In particular, where a polyester having a high melting temperature, is used such as polyethylene terephthalate, the spinning temperature should also be high, rendering the polyoxyalkylene glycol part susceptible to decompose by oxidation or heat. It is effective for preventing this decomposition to add a hindered phenol-based antioxidant before fiber formation in an amount of 1 to 30% by weight based on the weight of N-POA compound.

The polyester herein includes those comprising a principal acid component of terephthalic acid and a principal glycol component of at least one glycol selected from among alkylene glycols having 2 to 6 carbon atoms, i.e. ethylene glycol, trimethylene glycol, tetramethylene glycol, pentamethylene glycol and hexamethylene glycol. Part of the terephthalic acid component of these polyesters may be replaced by other difunctional carboxylic acids. Examples of other difunctional carboxylic acids are aromatic dicarboxylic acids such as isophthalic acid, metal salts of 5-sulfoisophthalic acid, naphthalenedicarboxylic acid, diphenyldicarboxylic acid and diphenoxyethanedicarboxylic acid; oxycarboxylic acids such as p-oxybenzoic acid and p-$\beta$-oxyethoxybenzoic acid; difunctional aliphatic carboxylic acids such as sebacic acid, adipic acid and oxalic acid; and difunctional alicyclic carboxylic acids such as 1,4-cyclohexanedicarboxylic acid. Likewise, part of the glycol component may be replaced by other glycol components. Examples of other glycol components are the above-mentioned glycols excluding the principal component glycol and aliphatic, alicyclic and aromatic diols, such as neopentyl glycol, 3-methylpentanediol, cyclohexanedimethanol, nonanediol, polyethylene glycol, bisphenol A and bisphenol S. These third components, however are preferably copolymerized in an amount of not more than 20 mol %. The most preferred polyesters in the present invention are those principally containing repeating units from ethylene terephthalate, butylene terephthalate or hexamethylene terepthalate.

The fibers of the present invention may contain known additives such as delusterants, catalysts, color and quality improving agents. The fibers of the present invention preferably have a fineness of 1 to 20 deniers, but their finenesses are not necessarily limited to this range and should be selected appropriately depending on their intended uses. For the achievement of high water absorbency, the fineness is preferably not more than 5 deniers, since the property increases with decreasing single fiber fineness. This is attributable, although not definitely stated at the moment, to a delicate balancing, in an aggregate of fiber, of the correlation between the hydrophilicity of the polymer itself and capillary effect produced by the fiber aggregate.

The fibers of the present invention may also be of irregular cross-sectional shapes other than circular. Thus, polyester fibers having high water absorbency can be obtained, with their cross-sectional shapes being, for example, of a multilobal type, such as trilobal, T-shaped, tetralobal, pentalobal, hexalobal, heptalobal or octalobal, or other various irregular shapes produced through spinnerets with holes having the corresponding shapes, insofar as the fibers are made from the polymer composition so far described comprising the specific agent capable of rendering them hydrophilic, and satisfy the above requirement for single fiber fineness. Among the above-described irregular cross-sectional shapes, those having a recess or recesses are more preferred, since they show a still higher water absorbency thanks to the recess exerting a capillary force which rapidly absorbs water.

The fibers may further be composite fibers of what is known as sheath-core structure or bimetal structure. In this case, the effect of the present invention is sufficiently produced with the presence of the polyester component containing the N-POA compound of the present invention on at least 20%, more preferably at least 40% of the fiber surface.

The fibers of the present invention, from polyesters containing the N-POA compound, can singly be processed into finished products or, as required, can suitably be blended with other fibers. Naturally, too low a blending ratio of the fibers of the present invention will result in insufficient water absorbency.

The level of water absorbency in the present invention can be judged by testing a nonwoven fabric prepared from specimen fiber for "water absorption ratio" and "repeated water absorption rate". These evaluation methods are described below.

A nonwoven fabric having a weight of 40 g/m$^2$ is prepared from a speciment staple fiber as follows. The specimen staple fiber is blended with 20% by weight of a fusible fiber (Sofit® N-710, a composite fiber made by Kuraray Co., Ltd.; the sheath component is polyethylene; 2 deniers$\times$51 mm). The blend is processed through a miniature card into a web having a weight of 40 g/m$^2$. The web is passed under water jets of a pressure of 30 kg/cm$^2$ at a speed of 5 m/min and water-entangled. Then the web is air-dried and heat treated in an auto-drier at 150° C. for 1 minute.

A 5 cm$\times$5 cm specimen of the thus prepared nonwoven fabric is placed on a plastic dish containing 0.2 g of water colored with red ink kept there for 1 second and then removed. The weight of water absorbed by the specimen is measured. The water absorption ratio herein is a mean value of repeated tests, n=10, where the quotient is of the weight thus measured divided by the weight of the specimen before the test.

For the repeated water absorption rate, a 5 cm$\times$5 cm specimen nonwoven fabric is dropped onto the surface of water and the time required for the water to spread all over the specimen is measured. The specimen thus tested is then sufficiently dried and subjected to the same test again. A mean value of repeated tests (n=10) is taken as the repeated water absorption rate.

The key feature of the fibers of the present invention lies in that their excellent water absorbency hardly decreases during repeated washing. It is possible to provide conventional polyester fibers with initial water absorbency by covering their surface with various processing agents, treating agents or finishing agents. Available for this purpose are various hydrophilic anti-soiling agents such as polyvinyl alcohol-based treating agents and polyesterethers, e.g. SR-1,000® made by Takamatsu Yushi Co., and various hydrophilic finishing agents including nonionic, anionic and cationic surfactants. Treatment with any of these agents can provide initial hydrophilicity, which, however, markedly decreases upon washing of the treated fiber. In contrast, it has been confirmed that the fibers of the present invention maintain their hydrophilicity even when subjected to repeated washing. The washing durability is herein evaluated by subjecting a nonwoven specimen to 10 washings in accordance with JIS L0217-103 and then determining the water absorption ratio and repeated water absorption rate of the specimen.

Conventional hydrophobic synthetic fibers show an initial water absorption ratio as determined according to the above method of less than 500%. On the other hand, the fibers of the present invention have been found to have generally a water absorption ratio of at least 500% and when the addition of the N-POA compound is comparatively large, have a water absorption ratio of at least 1,000%, which decreased very little during 10 repeated washings. Conventional polyester fibers treated on their surface with an agent that gives water absorbency often show an initial water absorption of not less than 500%, which however considerably decreases during 10 repeated washings.

With respect to the repeated absorption rate, it is more than 60 seconds with conventional hydrophobic synthetic fibers. With the fibers of the present invention, the repeated absorption rate however is not more than 60 seconds, and almost instantaneous, i.e. 0, when the N-POA compound has been added in a large amount, with the repeated absorption rate increasing little after 10 washings.

Accordingly, the present invention can provide, by adding an appropriate N-POA compound in an appropriate amount and by selecting appropriate fiber formation conditions, the fibers of the present invention that have remarkable water absorbency resistant to washing.

Besides testing a specimen in the form of nonwoven fabric, water absorbency can also be evaluated by testing it in the form of a staple fiber mass. Thus there are available: a test procedure which comprises hand-combing a speciment staple fiber, then adding water dropwise onto the thus opened web and measuring the area of the wet; a test which comprises immersing a specimen staple fiber in water and then separating excess water from the immersed fiber with a centrifugal separator, followed by measurement of the residual water content; a test which comprises permitting a thin open-ended glass tube filled with a speciment staple fiber to stand upright on a dish containing water and checking the water drawing-up rate; and a test which comprises dropping a wire basket having a specific weight and containing a specific weight of a specimen staple fiber onto a water surface and measuring the time required for the basket to entirely sink in the water. These test all show that the fibers of the present invention have excellent water absorbency as compared with conventional polyester fibers.

The fibers of the present invention are suitably applied for uses requiring water absorbency, for Example, waddings for Japanese style bedding, nonwoven fabrics, mops and wipes, towels and bath towels, bath mats, wicks for fiber-tipped pens, and the like. They are also suitably used for wet-laid nonwoven fabrics.

Other features of the invention will become apparent in the course of the following descriptions of exemplary embodiments which are given for illustration of the invention and are not intended to be limiting thereof. In the Examples and Comparative Examples that follow, the washing test was conducted in accordance with JIS L0217-103 as follows. washing solution is prepared by dissolving a synthetic washing agent for clothing in water at 40° C. to a concentration of 2 g/l. Specimen nonwoven fabrics and as required other conventional fabrics for loading purpose are thrown in the washing solution in a bath ratio of 1:30 and washing is started. The washing machine used is run for 5 minutes, and the specimens and the other fabrics are dewatered in a centrifuge. The washing solution is replaced by the same volume of a fresh water at a room temperature and the objects are rinsed for 2 minutes and then air-dried. The above steps are repeated 10 times to provide a specimen to be tested for absorbency after 10 washings.

EXAMPLES 1 THROUGH 3

A polyethylene terephthalate having an intrinsic viscosity [η] of 0.62 dl/g, as measured in a 1/1 mixed solvent of phenol and tetrachloroethane at 30° C., was melted and to the melt were added the amounts shown in Table 1 of an N-polyoxyalkylenepolyalkylenepolyamine compound of formula (2) an HLB of 12.0, and an average molecular weight of about 50,000, and containing a small amount of a hindered phenol antioxidant.

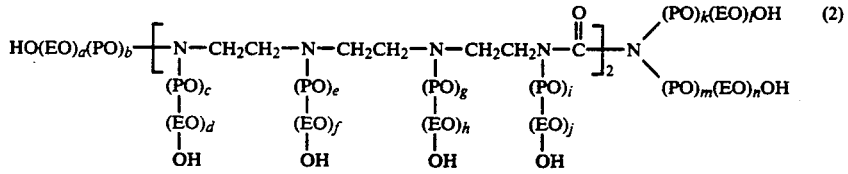

(2)

where PO and EO mean

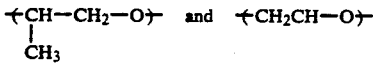

respectively and a through n each represents 0 or an integer of 1 or more.

The compositions obtained were each homogeneously mixed through a static mixer, then extruded through a spinneret, heated 285° C. having circular holes to the spun yarns and taken up at 1,000 m/min. The as-spun yarns obtained were subjected to the successive steps of drawing by 390% through a water bath at 75° C., shrinking by 8% in a water bath at 95° C., mechanical crimping, application of 0.1% by weight of a finish principally containing an ethylene oxide adduct of stearyl phosphate, heat treatment at 150° C. for 10 minutes under relaxed condition, and cutting to a length of 51 mm, to give three types of staple fibers having a single fiber fineness of 2 deniers. The fiber formability was good with no noticeable problems.

The staple fibers were each mixed with 20% by weight of a fusible composite fiber (Sofit® N-710, polyethylene/polyester sheath-core fiber, made by Kuraray Co.) and the mixtures were separately formed into webs through a card and a random webber. The webs obtained were treated with high-pressure water jets under a water pressure of 30 kg/cm$^2$ to give entangled-fiber nonwoven fabrics having a weight of 40 g/m$^2$.

The nonwoven fabrics thus obtained were tested for water absorption ratio and repeated water absorption rate under the standard conditions of 20° C. and 65% RH. The results are shown in Table 1. As seen from the table, there were obtained fibers with excellent water absorbency with durability.

EXAMPLES 4 AND 5

Example 1 was repeated except for using N-POA compounds having the same molecular structure as formula (2) and different HLB values, i.e. HLB = 8.0 for Example 4 and 15.0 for Example 5. In both cases the fiber formability was good and fibers having excellent water absorbency with durability were obtained, as shown in Table 1.

EXAMPLE 6

Example 1 was repeated except for using an N-POA compound having the same molecular structure as formula (2) and an average molecular weight of about 20,000. The fiber formability was good and the fiber obtained showed excellent durable water absorbency, as shown in Table 1.

EXAMPLES 7 AND 8

Example 1 was repeated except for using spinnerets with irregularly shaped holes, i.e. one with U-shaped holes for Example 7 and T-shaped for Example 8. In both cases the fiber formability was good and fibers having excellent water absorbency with durability were obtained, as shown in Table 1.

EXAMPLE 9

Sheath-core composite spinning was conducted with a polyester containing 5% by weight of the same N-POA compound as used in Example 1 as the sheath and a polyethylene terephthalate having an [η] of 0.67 dl/g as the core with a core/sheath weight ratio of 50/50, the fiber cross section being circular. The spinning head temperature was 290° C. and the take-up speed was 1,000 m/min. The as-spun yarn obtained was drawn through a water bath at 75° C. in a drawing ratio of 4.2 and then shrunk by 8% in a water bath at 95° C. to give a drawn yarn having a single filament fineness of 2 deniers. The thus drawn fiber was mechanically crimped, applied with the same finish as used in Example 1, dried and heat treated under relaxed condition at 150° C. for 10 minutes, and then cut to a length of 51 mm, to give a staple fiber. The fiber formability was good with no problems experienced.

The fiber thus obtained was formed into a nonwoven fabric in the same manner as in Example 1, which was then tested for water absorbency. As a result it was found that the fiber had excellent water absorbency with durability.

EXAMPLE 10

A polybutylene terephthalate having an intrinsic viscosity [η] of 0.85 dl/g, as measured in a 1/1 mixed solvent of phenol and tetrachloroethane at 30° C., was used. A staple fiber having a single fiber fineness of 5 deniers was prepared by conducting melt spinning, water-bath drawing and mechanical crimping, under the conditions shown in Table 1. The staple fiber thus obtained was tested for water absorbency characteristics in the same manner. The results are shown in Table 1.

EXAMPLE 11

A polyhexamethylene terephthalate having an intrinsic viscosity [η] of 1.05 dl/g, as measured in a 1/1 mixed solvent of phenol and tetrachloroethane, of was used. A staple fiber having a single fiber fineness of 5 deniers was prepared by conducting melt spinning at 200° C., water-bath drawing and mechanical crimping, under the conditions shown in Table 1. The staple fiber thus obtained was tested for water absorbency characteristics in the same manner. The results are shown in Table 1.

EXAMPLE 12

Example 1 was repeated except for using an N-POA having the molecular structure of formula (3), an HLB of 12.0 and an average molecular weight of about 50,000:

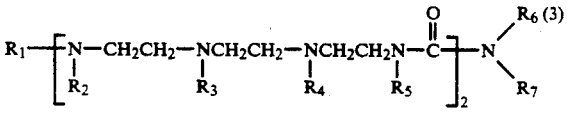

where $R_1$ through $R_7$ are each a group of a random copolymer of PO and EO.

The fiber formability was good and a fiber having excellent water absorbency was obtained as shown in Table 1.

COMPARATIVE EXAMPLES 1 AND 2

In Comparative Example 1, Example 1 was repeated except for using a polyethylene terephthalate having an [η] of 0.68 dl/g to obtain a fiber. The fiber was formed into a nonwoven fabric in the same manner, and the fabric was tested for water absorbency. The results obtained were extremely inferior to those in Example 1.

In Comparative Example 2, a polyvinyl alcohol-based hygroscopic agent was applied in an amount of about 1.5% by weight to the staple fiber prepared in Comparative Example 1, and the thus treated fiber was formed in the same manner into a nonwoven fabric, which was then tested for water absorbency. Although the finished staple fiber showed a good water absorbency, the nonwoven fabric prepared therefrom by water-jet entanglement treatment showed a greatly decreased water absorbency both initially and after the washings.

COMPARATIVE EXAMPLES 3 AND 4

In Comparative Example 3, Example 1 was repeated except that the N-POA compound of formula (2) containing a small amount of a hindered phenol antioxidant was added to the polyester in as small an amount as 0.1% by weight. The fiber obtained showed a lower level of water absorbency than that in Example 1.

In Comparative Example 4, the above compound with the antioxidant was added in as large an amount as 25% by weight. Stable spinning could not be performed due to a large decrease in the viscosity of the composition at spinning.

COMPARATIVE EXAMPLE 5

Example 1 was repeated except that an N-POA compound having the same structure as (2) but having a molecular weight of about 8,000 was used. Stable spinning could not be performed due to a large decrease in viscosity at spinning, which caused frequent spinneret clogging, many fluffs and frequent yarn breakages.

COMPARATIVE EXAMPLE 6

Example 1 was repeated except that an N-POA compound was used having structure (2) and an HLB of 5.0, i.e. containing hydrophobic PO segments in a large amount. Although the fiber formability was good, the fiber obtained showed an insufficient water absorbency level.

COMPARATIVE EXAMPLE 7

Example 1 was repeated except that an N-POA compound was used having structure (2) and an HLB of 18.0, i.e. containing hydrophilic EO segments in a large amount. Although the fiber formability was good, the water absorbency of the obtained fiber, while good initially, decreased after washing.

COMPARATIVE EXAMPLE 8 AND 9

Example 1 was repeated except for using, instead of N-POA, an EO-PO block copolymer (Comparative Example 8) or an EO-PO random copolymer (Comparative Example 9). The results shown in Table 1 indicate that the obtained fibers both had water absorbency with poor durability.

COMPARATIVE EXAMPLE 10 AND 11

Example 1 was repeated except for using, instead of N-POA, a polymer represented by formula (4) (Comparative Example 10) and one represented by formula (5) (Comparative Example 11), to obtain polyester fibers. The results of evaluation on their water absorbency are shown in Table 1.

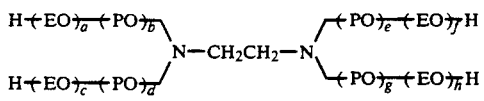

(4)

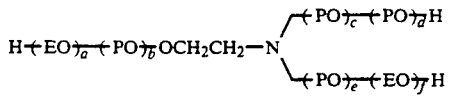

(5)

Obviously, numerous modifications and variations of the present invention are possible in light of the above teachings. It is therefore to be understood that within the scope of the appended claims, the invention may be practiced otherwise than as specifically described herein.

TABLE 1-1

| | Polymer | Agent added | HLB | Amine value | Molecular weight | Weight added | Spinning: Cross section | Spinning: Homofil or Heterofil |
|---|---|---|---|---|---|---|---|---|
| Ex. 1 | Polyethylene terephthalate | N-POA compound of formula (2) | 12.0 | 4.5 | 50,000 | 5.0 | Circular | Homofil |
| Ex. 2 | Polyethylene terephthalate | N-POA compound of formula (2) | " | " | " | 2.0 | " | " |
| Ex. 3 | Polyethylene terephthalate | N-POA compound of formula (2) | " | " | " | 10.0 | " | " |
| Ex. 4 | Polyethylene terephthalate | N-POA compound of formula (2) | 8.0 | 4.5 | " | 5.0 | " | " |
| Ex. 5 | Polyethylene terephthalate | N-POA compound of formula (2) | 15.0 | 5.0 | " | " | " | " |
| Ex. 6 | Polyethylene terephthalate | N-POA compound of formula (2) | 12.0 | 4.5 | 20,000 | 5.0 | " | " |
| Ex. 7 | Polyethylene terephthalate | N-POA compound of formula (2) | " | " | 50,000 | " | U-shaped | " |
| Ex. 8 | Polyethylene terephthalate | N-POA compound of formula (2) | " | " | " | " | T-shaped | " |
| Ex. 9 | Polyethylene terephthalate | N-POA compound of formula (2) | " | " | " | " | Circular | Heterofil |
| Ex. 10 | Polybutylene terephthalate | N-POA compound of formula (2) | " | " | " | " | " | Homofil |
| Ex. 11 | Poly-hexamethylene terephthalate | N-POA compound of formula (2) | " | " | " | " | " | " |
| Ex. 12 | Polyethylene terephthalate | N-POA compound of formula (3) | 12.0 | 5.0 | 50,000 | " | " | " |
| Comp. Ex. 1 | Polyethylene terephthalate | — | — | — | — | — | Circular | Homofil |
| Comp. Ex. 2 | Polyethylene terephthalate | —* | — | — | — | — | " | " |
| Comp. Ex. 3 | Polyethylene terephthalate | N-POA compound of formula (2) | 12.0 | 4.5 | 50,000 | 0.1 | " | " |
| Comp. Ex. 4 | Polyethylene terephthalate | N-POA compound of formula (2) | " | " | " | 25.0 | " | " |
| Comp. Ex. 5 | Polyethylene terephthalate | N-POA compound of formula (2) | " | " | 8,000 | 5.0 | " | " |
| Comp. Ex. 6 | Polyethylene terephthalate | N-POA compound of formula (2) | 5.0 | 7.5 | 50,000 | 5.0 | " | " |

TABLE 1-1-continued

| | | | | | | | | |
|---|---|---|---|---|---|---|---|---|
| Comp. Ex. 7 | Polyethylene terephthalate | N-POA compound of formula (2) | 18.0 | 5.5 | " | " | " | " |
| Comp. Ex. 8 | Polyethylene terephthalate | EO-PO block copolymer | 12.0 | — | 20,000 | " | " | " |
| Comp. Ex. 9 | Polyethylene terephthalate | EO-PO random copolymer | " | — | 30,000 | " | " | " |
| Comp. Ex. 10 | Polyethylene terephthalate | Compound of formula (4) | 12.0 | 4.5 | 50,000 | 5.0 | " | " |
| Comp. Ex. 11 | Polyethylene terephthalate | Compound of formula (5) | 12.0 | 4.5 | " | " | " | " |

| | Water absorbent property | | | | |
|---|---|---|---|---|---|
| | Absorption ratio | | Repeated absorption rate | | Fiber |
| | Initial | After 10 washings | Initial (sec) | After 10 washings (sec) | form-ability |
| Ex. 1 | 1250 | 1230 | 1.5 | 1.5 | ○ |
| Ex. 2 | 850 | 840 | 5.5 | 7.0 | ○ |
| Ex. 3 | 1550 | 1530 | Instan-taneous | Instan-taneous | ○ |
| Ex. 4 | 830 | 830 | 6.0 | 6.0 | ○ |
| Ex. 5 | 1350 | 1050 | Instan-taneous | 3.0 | ○ |
| Ex. 6 | 1230 | 1130 | 1.5 | 2.5 | ○ |
| Ex. 7 | 1530 | 1530 | 0.5 | 0.5 | ○ |
| Ex. 8 | 1490 | 1480 | 0.6 | 0.6 | ○ |
| Ex. 9 | 1240 | 1230 | 1.5 | 1.5 | ○ |
| Ex. 10 | 1200 | 1200 | 1.5 | 2.0 | ○ |
| Ex. 11 | 1150 | 1150 | 1.5 | 2.0 | ○ |
| Ex. 12 | 880 | 870 | 3.5 | 4.5 | ○ |
| Comp. Ex. 1 | 300 | 300 | At least 60 | At least 60 | ○ |
| Comp. Ex. 2 | 410 | 310 | At least 60 | At least 60 | ○ |
| Comp. Ex. 3 | 380 | 380 | At least 60 | At least 60 | ○ |
| Comp. Ex. 4 | — | — | — | | X |
| Comp. Ex. 5 | — | — | — | | X |
| Comp. Ex. 6 | 370 | 370 | 40.0 | 45.0 | ○ |
| Comp. Ex. 7 | 1050 | 450 | 3.0 | At least 60 | ○ |
| Comp. Ex. 8 | 800 | 430 | 4.5 | At least 60 | ○ |
| Comp. Ex. 9 | 750 | 400 | " | At least 60 | ○ |
| Comp. Ex. 10 | 850 | 400 | 4.0 | At least 60 | ○ |
| Comp. Ex. 11 | 890 | 420 | " | At least 60 | ○ |

*after-treated.

What is claimed is:

1. A polyester fiber containing polyester and 0.2 to 20% by weight of a compound having a polyalkylenepolyamine skeleton to which groups having a polyalkylene oxide chain are bonded and having an HLB of 6.0 to 16.0, an average molecular weight of at least 10,000 and an amine value of not more than 500.

2. A polyester fiber according to claim 1, wherein said compound having a polyalkylenepolyamine skeleton to which groups having a polyalkylene oxide chain are bonded is a compound of formula (1)

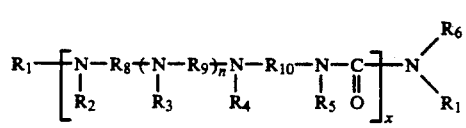

(1)

wherein $R_1$ through $R_7$ are each a group having a polyalkylene oxide chain or a hydrogen atom, but are not all hydrogen atoms, $R_8$ through $R_{10}$, which may be the same or different, are each a lower alkylene group having 2 to 4 carbon atoms; n is 0 or an integer of 1 to 9 and x is an integer of 1 to 20.

3. A polyester fiber according to claim 1, wherein said compound having a polyalkylenepolyamine skeleton to which groups having a polyalkylene oxide chain are bonded is a compound having a molecular weight of 10,000 to 100,000 of formula (2)

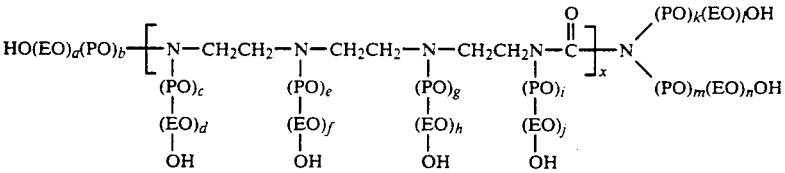

(2)

wherein PO and EO mean

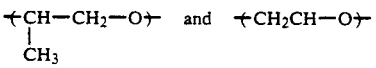

respectively, a through n each represent 0 or an integer of 1 or more and x represents an integer of 1 to 5.

4. A polyester fiber according to claim 1, wherein said compound, having a polyalkylenepolyamine skeleton to which groups having a polyalkylene oxide chain are bonded, has an amine value of not more than 100.

5. A polyester fiber according to claim 1, said fiber further containing a hindered phenol antioxidant.

6. A polyester fiber according to claim 1, said fiber having a cross-sectional shape having at least one recession.

7. A polyester fiber according to claim 1, wherein said polyester fiber has a fineness of less than or equal to 5 deniers.

8. A polyester fiber according to claim 1, wherein said polyester, which forms the fiber in combination with said compound having a polyalkylene-polyamine skeleton to which groups having a polyalkylene oxide chain are bonded, comprises an acid component and a glycol component and wherein said acid component comprises terephthalic acid.

9. A polyester fiber according to claim 8, wherein said polyester further comprises not more than 20 mol %, based on the total moles of acid component, of a difunctional carboxylic acid selected from the group consisting of aromatic, aliphatic and alicyclic dicarboxylic acids other than terephthalic acid.

10. A polyester fiber according to claim 1, wherein said polyester, which forms the fiber in combination with said compound having a polyalkylene-polyamine skeleton to which groups having a polyalkylene oxide chain are bonded, comprises an acid component and a glycol component and wherein said glycol component is selected from the group consisting of alkylene glycols having 2 to 6 carbon atoms.

11. A polyester fiber according to claim 10, wherein said polyester further comprises not more than 20 mol %, based on the total moles of diol component, of a glycol selected from the group consisting of aliphatic, aromatic and alicyclic diols other than alkylene glycols having 2 to 6 carbon atoms.

* * * * *

UNITED STATES PATENT AND TRADEMARK OFFICE

CERTIFICATE OF CORRECTION

PATENT NO. : 5,178,945

DATED : January 12, 1993

INVENTOR(S) : Masao Kawamoto et al.

It is certified that error appears in the above-identified patent and that said Letters Patent is hereby corrected as shown below:

On the title page, Item [30],

The Foreign Application Priority Data has been omitted, should read as follows: --Mar. 5, 1990 [JP] Japan.....2-54283--

Signed and Sealed this

Thirtieth Day of November, 1993

*Attest:*

*Attesting Officer*

BRUCE LEHMAN

*Commissioner of Patents and Trademarks*